US010417995B2

(12) United States Patent
Xu et al.

(10) Patent No.: US 10,417,995 B2
(45) Date of Patent: Sep. 17, 2019

(54) METHODS AND SYSTEMS OF REDUCING POWER CONSUMPTION OF DISPLAY PANELS

(71) Applicant: Shenzhen China Star Optoelectronics Technology Co., Ltd., Shenzhen, Guangdong (CN)

(72) Inventors: Jing Xu, Guangdong (CN); Tai-jiun Hwang, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 515 days.

(21) Appl. No.: 15/031,745

(22) PCT Filed: Mar. 16, 2016

(86) PCT No.: PCT/CN2016/076481
§ 371 (c)(1),
(2) Date: Apr. 24, 2016

(87) PCT Pub. No.: WO2017/143635
PCT Pub. Date: Aug. 31, 2017

(65) Prior Publication Data

US 2018/0082660 A1 Mar. 22, 2018

(30) Foreign Application Priority Data

Feb. 22, 2016 (CN) ..... 2016 1 0096425

(51) Int. Cl.
*G09G 5/10* (2006.01)
*G09G 3/3208* (2016.01)

(52) U.S. Cl.
CPC ..... *G09G 5/10* (2013.01); *G09G 3/3208* (2013.01); *G09G 2320/0626* (2013.01); *G09G 2320/0673* (2013.01); *G09G 2330/021* (2013.01)

(58) Field of Classification Search
CPC ..... G09G 3/22; G09G 3/3208; G09G 5/10; G09G 2330/021
See application file for complete search history.

(56) References Cited

U.S. PATENT DOCUMENTS 7,369,183 B2 5/2008 Oka et al.
8,149,250 B2 4/2012 Burkhardt et al.
(Continued)

FOREIGN PATENT DOCUMENTS

CN 101324722 A 12/2008
CN 101673520 A * 3/2010
(Continued)

*Primary Examiner* — Mark Edwards
(74) *Attorney, Agent, or Firm* — Andrew C. Cheng

(57) ABSTRACT

A method of reducing the power consumption of the display panels includes: obtaining a brightness of each of pixels of an image to be displayed on the display panel; calculating an average brightness of the image in accordance with the brightness of each of the pixels of the image; obtaining a brightness adjustment coefficient in accordance with the average brightness; decreasing the brightness of each of the pixels of the image in accordance with the brightness adjustment coefficient; and enhancing a contrastness between the pixels of the image in accordance with the brightness adjustment coefficient. In addition, a system of reducing the power consumption of the display panels is also disclosed. In this way, the power consumption of the display panel may be reduced, and the contrastness of the displayed image may be enhanced.

18 Claims, 5 Drawing Sheets

(56) References Cited

U.S. PATENT DOCUMENTS

| | | | | |
|---|---|---|---|---|
| 2001/0035850 | A1* | 11/2001 | Okamoto | G09G 3/3406 345/77 |
| 2013/0093783 | A1* | 4/2013 | Sullivan | G09G 5/06 345/601 |
| 2014/0368525 | A1* | 12/2014 | Faaborg | G09G 5/02 345/589 |

FOREIGN PATENT DOCUMENTS

| | | | | |
|---|---|---|---|---|
| CN | 101673520 | A | | 3/2010 |
| CN | 101739973 | A | | 6/2010 |
| CN | 101877208 | A | * | 11/2010 |
| CN | 101877208 | A | | 11/2010 |
| CN | 103024320 | A | | 4/2013 |
| CN | 103413536 | A | | 11/2013 |
| JP | 08317250 | A | | 11/1996 |
| JP | 2008175958 | A | | 7/2008 |

* cited by examiner

METHODS AND SYSTEMS OF REDUCING POWER CONSUMPTION OF DISPLAY PANELS

BACKGROUND OF THE INVENTION

1. Field of the Invention

The present disclosure relates to display panel technology, and more particularly to a method and a system of reducing power consumption of display panels.

2. Discussion of the Related Art

Organic Light-Emitting Diode (OLED) is a newly developed display technology characterized by attributes such as, self-light-emitting, high contrastness, and high color domain coverage, and thus plays an important role in this area. Nevertheless, the life cycle of the OLED limits the development of the OLED, which may be caused by external and internal factors. The change of the operational voltage and the reduction of the light emitting efficiency may be the internal factors.

In order to slow down the aging of the OLED display panels, usually, the current may be decreased and the brightness of the display images may be reduced by adjusting the data, Gamma voltage or the power supply voltage. In this way, not only the power consumption of the display panel may be reduced, the aging issue of the display panel may also be slowed down. However, the contrastness of the images may be reduced when the brightness of the images is reduced, which deteriorates the performance of the display panel.

SUMMARY

The present disclosure relates to a method and a system of reducing power consumption of display panels to overcome the above problems.

In one aspect, a method of reducing power consumption of display panels includes: obtaining a brightness of each of pixels of an image to be displayed on the display panel; calculating an average brightness of the image in accordance with the brightness of each of the pixels of the image; obtaining a brightness adjustment coefficient in accordance with the average brightness; decreasing the brightness of each of the pixels of the image in accordance with the brightness adjustment coefficient; and enhancing a contrastness between the pixels of the image in accordance with the brightness adjustment coefficient.

Wherein the step of obtaining the brightness of each of pixels of the image to be displayed on the display panel further includes: obtaining grayscale values of R, G, and B components of the image; and converting the grayscale values of the R, G, and B components into a brightness of a YcbCr space.

Wherein the step of obtaining the brightness of each of pixels of the image to be displayed on the display panel further includes: obtaining grayscale values of R, G, and B components of the image; and selecting a maximum value among the grayscale values of the R, G, and B components to be the brightness.

Wherein the step of calculating an average brightness of the image in accordance with the brightness of each of the pixels of the image further includes: applying a Gamma transformation to the brightness of each of the pixels of the image; and calculating an average brightness of the image in accordance with the brightness after the Gamma transformation;

Wherein the step of obtaining a brightness adjustment coefficient in accordance with the average brightness further includes: searching a corresponding value of the average brightness on a predetermined brightness adjustment curve, and obtaining a brightness adjustment coefficient in accordance with the corresponding value.

Wherein the brightness adjustment curve is a curve showing a relationship between the average brightness and the brightness of one specific pixel after the adjustment, and the brightness adjustment coefficient is obtained in accordance with the adjusted brightness of the pixel and the brightness of the pixel before the adjustment.

Wherein the step of enhancing the contrastness between the pixels of the image in accordance with the brightness adjustment coefficient further includes: reducing a Gamma voltage or a driving voltage of the display panel, changing data by a digital method, or decreasing the brightness of each of the pixels of the image.

Wherein the step of enhancing the contrastness between the pixels of the image in accordance with the brightness adjustment coefficient further includes: configuring an enhanced degree of the contrastness between the pixels of the displayed pixel to be lower when the brightness adjustment coefficient is larger, and configuring the enhanced degree of the contrastness between the pixels of the displayed pixel to be higher when the brightness adjustment coefficient is smaller.

Wherein: when the brightness adjustment coefficient is larger, the brightness of the pixel having a low grayscale is decreased to be at a lower degree, and the enhanced degree of the brightness of the pixel having a high grayscale is increased to be at the lower degree; and when the brightness adjustment coefficient is smaller, the brightness of the pixel having a low grayscale is decreased to be at a higher degree, and the enhanced degree of the brightness of the pixel having a high grayscale is increased to be at the higher degree.

In another aspect, a system of reducing the power consumption of display panels includes: a pixel brightness obtaining module is configured for obtaining a brightness of each of pixels of an image to be displayed of a display panel; an average brightness calculation module is configured for calculating an average brightness value of the image in accordance with the brightness of each of the pixels; a calculation module of brightness adjustment coefficient is configured for obtaining a brightness adjustment coefficient in accordance with the average brightness; a brightness execution module is configured for decreasing the brightness of each of the pixels of the image in accordance with the brightness adjustment coefficient; and a contrastness execution module is configured for enhancing a contrastness between the pixels of the image in accordance with the brightness adjustment coefficient.

Wherein the pixel brightness obtaining module further includes: a pixel grayscale obtaining unit configured for obtaining grayscale values of R, G, and B components of the image; and a pixel brightness calculation unit configured for converting the grayscale values of the R, G, and B components into the brightness under the YcbCr space, or selecting a maximum grayscale value among the R, G, and B components to be the brightness.

Wherein the average brightness calculation module further includes: a conversion unit configured for applying a Gamma transformation toward the brightness of each of the pixels of the image; an average brightness calculation unit configured for calculating the average brightness of the image in accordance with the transformed brightness.

Wherein the calculation module of brightness adjustment coefficient is configured for searching a corresponding value of the average brightness on a predetermined brightness adjustment curve, and for obtaining a brightness adjustment coefficient in accordance with the corresponding value.

Wherein the brightness adjustment curve is a curve showing a relationship between the average brightness and the brightness of one specific pixel after the adjustment, and the brightness adjustment coefficient is obtained in accordance with the adjusted brightness of the pixel and the brightness of the pixel before the adjustment.

Wherein the brightness execution module is configured for decreasing the brightness of the image by reducing a Gamma voltage or a driving voltage of the display panel, changing data by a digital method, or decreasing the brightness of each of the pixels of the image.

Wherein the contrastness execution module is configured for configuring an enhanced degree of the contrastness between the pixels of the displayed pixel to be lower when the brightness adjustment coefficient is larger, and configuring the enhanced degree of the contrastness between the pixels of the displayed pixel to be higher when the brightness adjustment coefficient is smaller.

Wherein the contrastness execution module is configured for: when the brightness adjustment coefficient is larger, the brightness of the pixel having a low grayscale is decreased to be at a lower degree, and the enhanced degree of the brightness of the pixel having a high grayscale is increased to be at the lower degree; and when the brightness adjustment coefficient is smaller, the brightness of the pixel having a low grayscale is decreased to be at a higher degree, and the enhanced degree of the brightness of the pixel having a high grayscale is increased to be at the higher degree.

In view of the above, the method includes: obtaining a brightness of each of pixels of an image to be displayed on the display panel; calculating an average brightness of the image in accordance with the brightness of each of the pixels of the image; obtaining a brightness adjustment coefficient in accordance with the average brightness; decreasing the brightness of each of the pixels of the image in accordance with the brightness adjustment coefficient; and enhancing a contrastness between the pixels of the image in accordance with the brightness adjustment coefficient. In this way, the brightness of each of the pixels in the displayed image may be decreased and the contrastness between each of the pixels of the displayed image may be enhanced by the brightness adjustment coefficient. In this way, the power consumption of the display panel may be reduced, and the contrastness of the displayed image may be enhanced.

DETAILED DESCRIPTION OF THE EMBODIMENTS

Embodiments of the invention will now be described more fully hereinafter with reference to the accompanying drawings, in which embodiments of the invention are shown.

In one embodiment, the OLED display panel is taken as one example to illustrate the method of reducing the power consumption of the display panels.

As the life cycle of OLED is not only affected by external environment, but also is affected by the structures and the materials of the component, efficiency and operational modes (DC or AC), and the driving methods. Thus, a variety of solutions may be adopted to extend the life cycle of the OLED, such as enhancing the manufacturing process, the materials, and the lighting efficiency, and also reducing the power consumption, which may reduce the impact toward the structure and the performance of the organic films caused by the generation heat.

OLED display devices are controlled by red, green, and blue pixels. When the brightness of the display images is high, the corresponding power source voltage and the driving voltage are also high, which results in high power consumption and high heat. The heat may affect the structure and the performance of the organic film, and the red, the green, and the blue pixels may decay quickly. When time goes by, color shift may occur, and which may be easily conceived by humans eyes.

Figure 1:
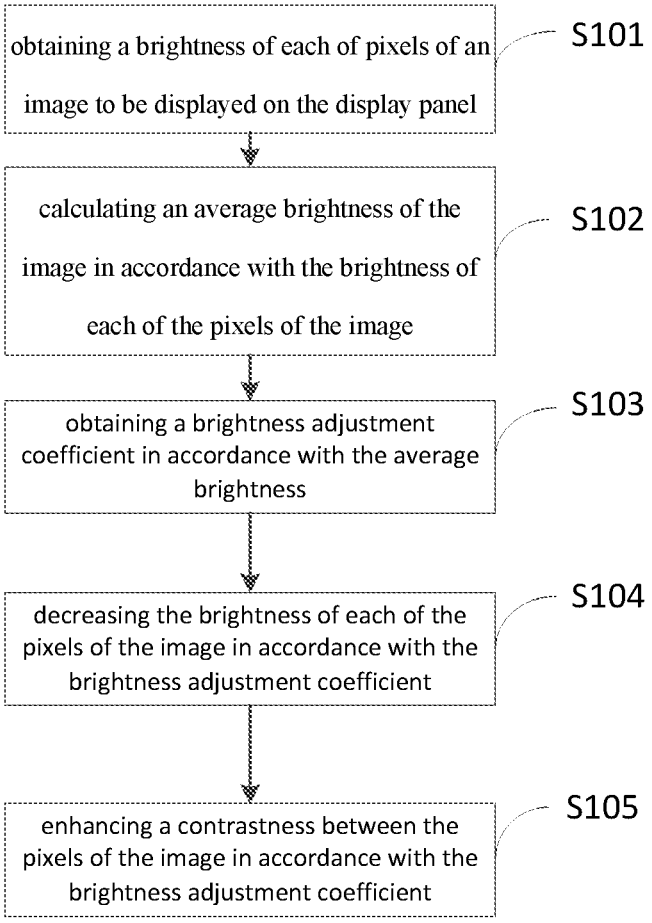
FIG. 1 is a flowchart illustrating the method of reducing power consumption of display panels in accordance with one embodiment.

It can be understood that although the conventional method of reducing power consumption relates to reducing the brightness of the displayed image thereby reducing the power consumption and the generated heat. However, the contrastness of the displayed image may be reduced at the same time. Thus, it is needed to enhance the contrastness of the displayed image. As shown in FIG. 1, the method includes the following steps:

In step S101, obtaining a brightness of each of the pixels of an image to be displayed on the display panel;

Specifically, the displayed image observed by the human includes a plurality of pixels, and each of the pixels includes a red (R), a green (G), and a blue (B) sub-pixels. Each of the sub-pixels may include different brightness, which may be represented by the grayscale values. It can be understood that more grayscale levels may achieve better display performance.

Taking a display panel having 8 bits as one example, there are totally 256 ($2^8$) degrees of brightness, that is, grayscale 0 to 255. Each of the pixels is composed of red, green, and blue sub-pixels having different grayscale values. That is, the brightness of each of the pixels on the display panel are caused by different grayscale values of the three RGB sub-pixels.

Figure 2:
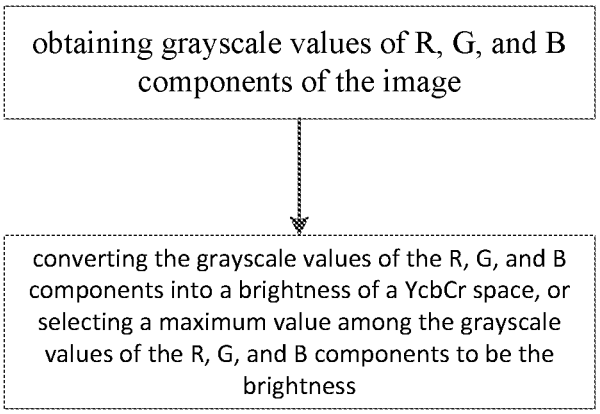
FIG. 2 is a flowchart illustrating the steps regarding step S101 of FIG. 1.

As shown in FIG. 2, the grayscale values of the R, G, B sub-pixels may be obtained to calculate the brightness of each of the pixels of the displayed image, and the calculation is shown below:

1) converting the grayscale values of the R, G, and B components into a brightness (Y) of a YcbCr space:

$$Y=0.299R+0.587G+0.114B;$$

Or 2) taking the maximum value among the grayscale values of the R, G, and B components to be the brightness (Y):

$$Y=\mathrm{Max}(R,G,B);$$

In other embodiments, other calculation methods may be adopted. In the first embodiment, the brightness of each of the pixels may be obtained by the above method. Further, a step S102 is conducted to calculate the average brightness of the displayed image in accordance with the brightness of each of the pixels.

Figure 3:
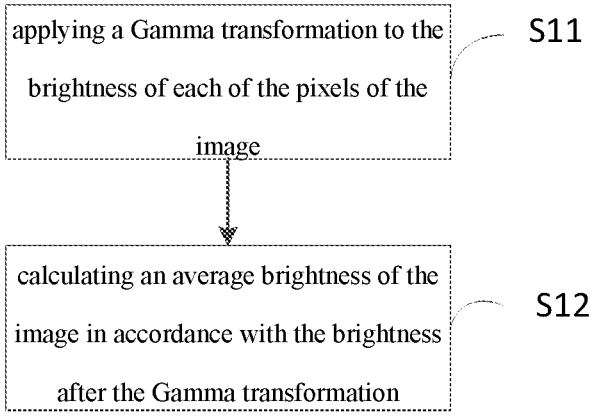
FIG. 3 is a flowchart illustrating the steps regarding S102 of FIG. 1.

As shown in FIG. 3, the step includes:

Sub-step S11: applying a Gamma transformation to the brightness of each of the pixels of the displayed image;

The equation may be adopted to perform the Gamma transformation:

$$Y'=(Y/255)^{GMA}\times 255;$$

Wherein Y' represents the brightness after the Gamma transformation, and GMA represents a Gamma value of the display panel. By applying the Gamma transformation to the brightness, a target value which best meet the Gamma characteristic of the display panel may be obtained. The number 255 represents a maximum grayscale value of the display panel, and which may be varied in accordance with the digits of the display panel. When the display panel is of 8 bits, the maximum grayscale value equals to 255. In other embodiment, when the display panel is of 10 bits, the maximum grayscale value equals to 1023.

Sub-step S12: calculating an average brightness value of the displayed image in accordance with the brightness after the Gamma transformation.

The average brightness value may be calculated by the equation below:

$$\mathrm{APL}=\Sigma_{i=1,j=1}^{i=m,j=n}Y'_{ij}/(m\times n),$$

Wherein APL represents an average brightness of the display image, m represents the number of rows, n represents the number of columns, and m×n represents the number of pixels within the displayed image. A range of the APL corresponds to the digits of the display panel. When the display panel is of 8 bits, $2^8$ brightness may be displayed, that is, the range is between 0 and 255. When the display panel is of 10 bits, $2^{10}$ brightness may be displayed, that is, the range is between 0 and 1023.

To facilitate the implementation, a normalization process may be applied to the APL:

$$\mathrm{APL}=\mathrm{APL}/255\times 100;$$

Wherein 255 is the maximum grayscale value for the display panel of 8 bits. When the display panel is of 10 bits, the maximum grayscale value for the display panel is 1023. The APL after the normalization process is in a range between 0 and 100.

In step S103, obtaining a brightness adjustment coefficient in accordance with the average brightness value.

Specifically, a value corresponding to the average brightness value may be obtained by referring to a predetermined brightness adjustment curve. In addition, the brightness adjustment coefficient may be obtained in accordance with the value.

The brightness adjustment curve is a curve showing the relationship between the average brightness and the brightness of one specific pixel after the adjustment. The brightness adjustment coefficient may be obtained by calculating a ratio of the adjusted brightness of the pixel and the brightness of the pixel before the adjustment. In another example, the brightness adjustment curve may be a curve showing the relationship between the average brightness and the brightness adjustment coefficient. That is, the brightness adjustment coefficient may be directly obtained in view of the curve. Thus, the value corresponding to the average brightness may be obtained by referring to the brightness adjustment curve.

Figure 4:
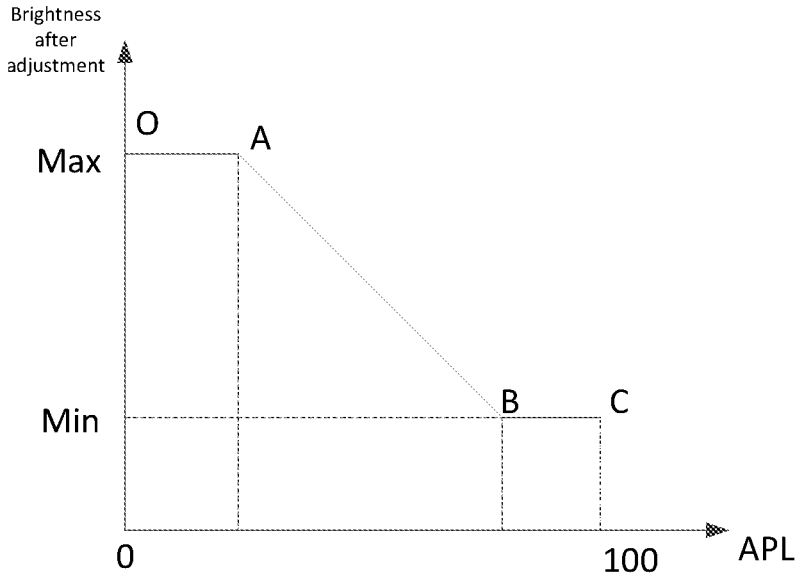
FIG. 4 is a brightness adjustment curve diagram of step S103 of FIG. 1.

As shown in FIG. 4, the brightness adjustment curve shows the relationship between the average bright ness and the adjusted brightness of one specific pixel within the displayed image. Generally, the specific pixel may be the pixel having the maximum grayscale value to simplify the functional relationship.

The brightness adjustment curve in FIG. 4 relates to the display panel of 8 bits, wherein the pixel having the maximum grayscale value 255 is selected. In view of the above calculation method, with respect to the pixel having the maximum grayscale value 255, the brightness is 255 before the adjustment.

The x-axis of FIG. 4 shows the APL having a range between 0 and 100, and the y-axis shows the brightness after the adjustment, and wherein the maximum value (Max) is 255. The curve may be divided into three sections including a horizontal line from point O to A, an oblique line from point A to B, and a horizontal line from point B to C. The oblique line from point A to B may be divided into a plurality of sections, and each of the sections includes different slope factors.

After the sub-step S12, a smaller APL denotes a lower average brightness of the displayed image. Between point O and A, the maximum brightness after the adjustment is 255, the brightness adjustment coefficient is one, and the brightness remains the same regardless of the brightness. When APL is between point A and B, the maximum brightness after the adjustment is smaller than 255, the brightness adjustment coefficient is smaller than one, and the brightness of the displayed image has to be reduced.

When APL is close to 100, the average brightness of the displayed image is large, and the power consumption is high. The corresponding brightness after the adjustment is limited to be below a minimum brightness range. At this moment, the brightness has to be greatly adjusted to reduce the brightness of the displayed image.

Figure 5:
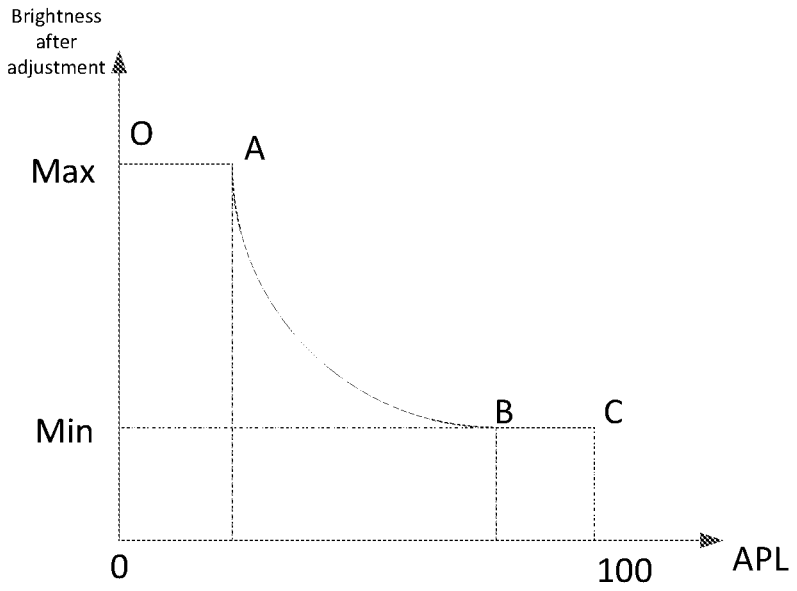
FIG. 5 is another brightness adjustment curve diagram of step S103 of FIG. 1.

FIG. 5 is another brightness adjustment curve diagram of step S103 of FIG. 1. The difference between FIG. 5 and FIG. 4 resides in that: the middle section of the curve is arc-shaped. Different APL corresponds to different slope factors. It is to be noted that the brightness adjustment curve is not limited to the above.

In step S104, the brightness of each of the pixels of the displayed image is reduced in accordance with the brightness adjustment coefficient.

The brightness adjustment coefficient obtained by the pixel having the maximum grayscale value may be suitable for all of the pixels of the displayed image. The brightness of all of the pixels may be adjusted by the brightness adjustment coefficient. The brightness adjustment coefficient is in a range between 0 and 1. When the brightness adjustment coefficient equals to one, the brightness remains the same regardless of the adjustment. In an example, the adjustment may be skipped or the adjustment may be conducted along with the brightness adjustment coefficient equals to one. When the brightness adjustment coefficient is smaller than one, it is needed to reduce the brightness of the displayed image by changing the data or by adjusting the Gamma voltage or the driving voltage of the display panel.

In step S105, enhancing the contrastness between the pixels of the displayed image in accordance with the brightness adjustment coefficient.

Specifically, the contrastness of the displayed image may be lower when the brightness adjustment coefficient is larger. Correspondingly, the contrastness is decreased for a lower degree, and the enhanced degree of the contrastness between the pixels of the displayed pixel may be configured to be lower. When the brightness adjustment coefficient is smaller, the brightness of the displayed image may be decreased for a higher degree. Correspondingly, the contrastness is decreased for a higher degree. Thus, the enhanced degree of the contrastness between the pixels of the displayed pixel may be configured to be higher. It can be understood that the enhanced degree of the contrastness is determined in accordance with the brightness adjustment coefficient. Usually, different contrastness enhancing algorithms may be configured for different brightness adjustment coefficients, such as the stretching change relationship or histogram equalization.

The contrastness of the displayed image relate to a ratio between the brightness of the brightest white and the darkest black. There are two ways to increase the ratio, including increasing the numerator or decreasing the denominator. That is, to increase the brightness of the brightest white and to decrease the brightness of the darkest black. With respect to each of the pixels of the displayed image, the brightness of the pixels having high grayscale values may be increased, and the brightness of the pixels having low grayscale values may be decreased, which contributes to enhance the contrastness of the displayed image.

Figure 6:
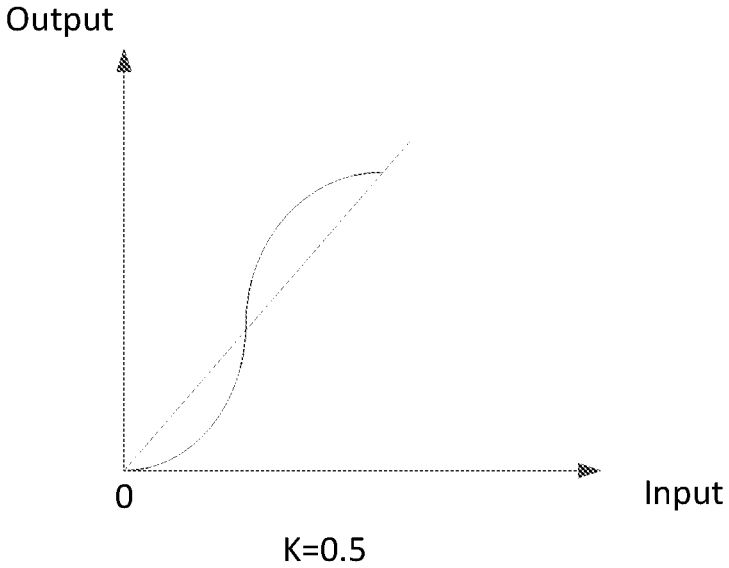
FIG. 6 is a relationship diagram showing the contrastness stretching in step S105 of FIG. 1 when the brightness adjustment parameter equals to 0.5.
Figure 7:
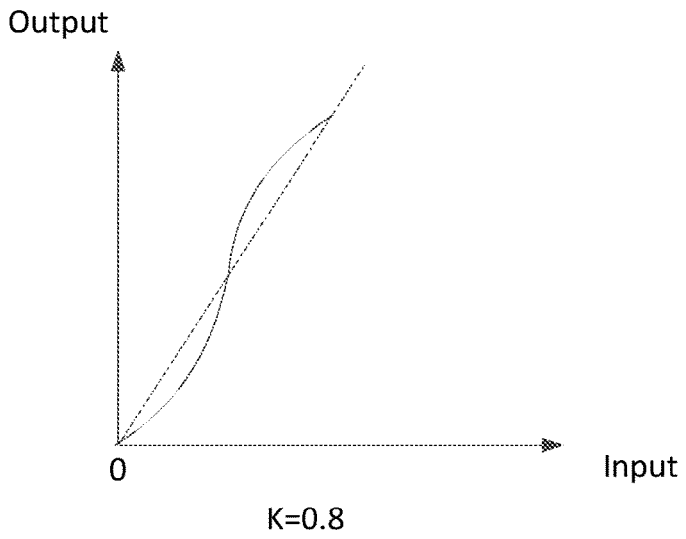
FIG. 7 is a relationship diagram showing the contrastness stretching in step S105 of FIG. 1 when the brightness adjustment parameter equals to 0.8.

FIGS. 6 and 7 are relationship diagrams showing the contrastness stretching when the brightness adjustment parameter equals to 0.5 and 0.8. The x-axis relates to the brightness of the inputted displayed image, and the y-axis relates to the brightness of the outputted displayed image. When below a specific brightness threshold, the brightness of the inputted displayed image is still at low grayscale, and the brightness of the outputted displayed image is decreased. When above the specific brightness threshold, the brightness of the inputted displayed image is at high grayscale, and the brightness of the outputted displayed image is increased so as to increase the contrastness of the outputted displayed image. The brightness of the displayed image after the enhancement is still lower than that of the displayed image before the enhancement so as to ensure the low power consumption of the display panel.

Comparing the data conversion curves in FIGS. 6 and 7, it can be conceived that the enhanced degree of the outputted displayed image of FIG. 6 is higher than that of the outputted displayed image of FIG. 7. The trend of the data conversion curve in FIG. 6 is steeper, which corresponds to the value of the above brightness adjustment coefficient.

The above steps relate to decrease the brightness and to increase the contrastness of the displayed image. It is to be noted that the OLED display panel is taken as on example. The proposed method of reducing the power consumption may be adopted by other kinds of display panels. In another example, the method of reducing the power consumption may be adopted by display panel, such as a LCD.

Figure 8:
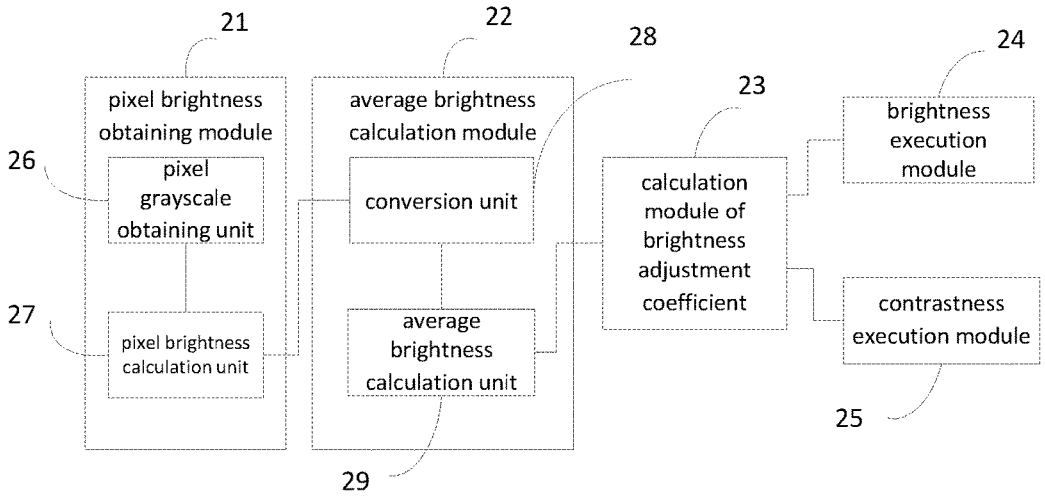
FIG. 8 is a block diagram of the system of reducing the power consumption of the display panels in accordance with one embodiment.

FIG. 8 is a block diagram of the system of reducing the power consumption of the display panels in accordance with one embodiment. The system includes a pixel brightness obtaining module 21, an average brightness calculation module 22, a calculation module of brightness adjustment coefficient 23, a brightness execution module 24 and a contrastness execution module 25. The pixel brightness obtaining module 21 includes a pixel grayscale obtaining unit 26 and a pixel brightness calculation unit 27. The average brightness calculation module 22 includes a conversion unit 28 and an average brightness calculation unit 29. The connection relationship between each of the modules and the units is shown in FIG. 8. However, it can be understood that the connection relationship in FIG. 8 is only one example. The modules/units may be coupled or communicated, directly or indirectly, via interfaces. In addition, the connections between the modules/unis may be electrical, mechanical or in other forms.

Specifically, in the embodiment, the pixel brightness obtaining module 21 is configured for obtaining the brightness of each of the pixels of the displayed image of the display panel. The average brightness calculation module 22 is configured for calculating the average brightness value of the displayed image in accordance with the brightness of each of the pixels. The calculation module of brightness adjustment coefficient 23 is configured for obtaining the brightness adjustment coefficient in accordance with the average brightness. The brightness execution module 24 is configured for deceasing the brightness of each of the pixels of the displayed image in accordance with the brightness adjustment coefficient. The contrastness execution module 25 is configured for enhancing the contrastness between the pixels of the displayed image in accordance with the brightness adjustment coefficient.

The pixel grayscale obtaining unit 26 of the pixel brightness obtaining module 21 is configured for obtaining the grayscale values of the R, G, and B components of the displayed image. The pixel brightness calculation unit 27 is configured for converting the grayscale values of the R, G, and B components into the brightness under the YcbCr space. Alternatively, the maximum grayscale value among the R, G, and B components is taken as the brightness.

The conversion unit 28 of the average brightness calculation module 22 is configured for applying the Gamma transformation toward the brightness of each of the pixels of the displayed image. The average brightness calculation unit 29 is configured for calculating the average brightness of the displayed image in accordance with the transformed brightness.

The calculation module of brightness adjustment coefficient 23 is configured for searching a corresponding value of the average brightness on the predetermined brightness adjustment curve, and is configured for obtaining the brightness adjustment coefficient in accordance with the corresponding value.

The contrastness execution module 25 configures the enhanced degree of the contrastness between the pixels to be lower when the brightness adjustment coefficient is larger, and the contrastness execution module 25 configures the enhanced degree of the contrastness between the pixels to be higher when the brightness adjustment coefficient is smaller.

In the embodiment, the grayscale obtaining unit obtains the grayscale values of the R, G, and B components of the displayed image. The pixel brightness calculation unit 27 calculates the brightness of each of the pixels, the conversion unit 28 performs the Gamma transformation, the average brightness calculation unit 29 calculates the average brightness of the displayed image, the calculation module of brightness adjustment coefficient 23 obtains the brightness adjustment coefficient, and the brightness execution module 24 decreases the brightness. At the same time, the contrastness execution module 25 enhances the contrastness to reduce the power consumption of the display panel so as to obtain a clear display.

Figure 9:
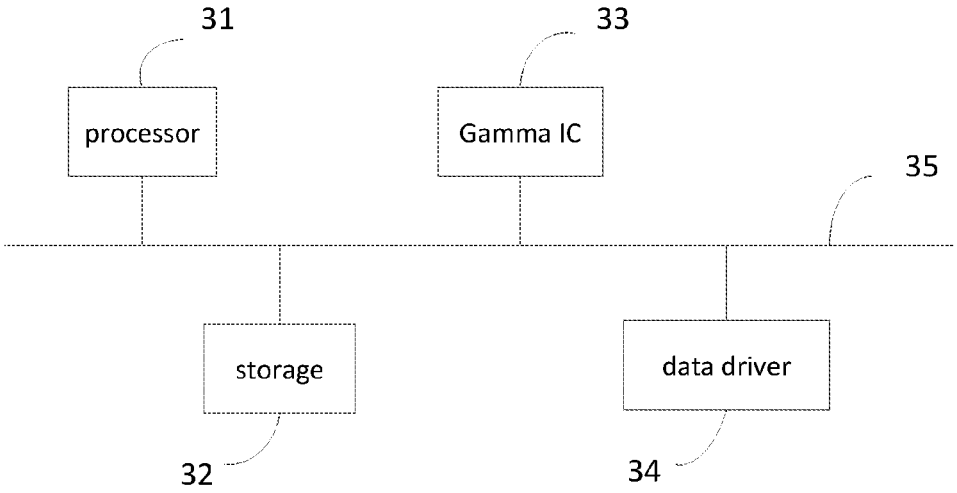
FIG. 9 is a block diagram of the system of reducing the power consumption of the display panels in accordance with another embodiment.

FIG. 9 is a block diagram of the system of reducing the power consumption of the display panels in accordance with another embodiment. The system includes a processor 31, a storage 32, a Gamma IC 33, a data driver 34, and a main wiring 35. The above components are connected with each other.

The processor 31 is configured to:

Obtaining the brightness of each of the pixels of the displayed image;

Calculating the average brightness of the displayed image in accordance with the brightness of each of the pixels;

Obtaining the brightness adjustment coefficient in accordance with the average brightness;

Decreasing the brightness of each of the pixels of the displayed image by the Gamma IC 33 or the data driver 34 in accordance with the brightness adjustment coefficient;

Wherein the processor 31 is configured for obtaining the grayscale values of the R, G, and B components of the displayed image, and converts the grayscale values of the R, G and B components to be the brightness under the YCbCr space. Alternatively, the maximum grayscale value among the R, G, and B components is taken as the brightness.

The processor 31 is configured for applying the Gamma transformation toward the brightness of each of the pixels of the displayed image, and is configured for calculating the average brightness of the displayed image in accordance with the transformed brightness.

The processor 31 is configured for searching a corresponding value of the average brightness on the predetermined brightness adjustment curve, and is configured for obtaining the brightness adjustment coefficient in accordance with the corresponding value.

The processor 31 configures the enhanced degree of the contrastness between the pixels to be lower when the brightness adjustment coefficient is larger, and configures the enhanced degree of the contrastness between the pixels to be higher when the brightness adjustment coefficient is smaller via the Gamma IC 33 and the data driver 34.

The storage 32 is configured for storing the brightness of each of the pixels, the average brightness, the brightness adjustment coefficient, the grayscale values of the R, G, and B components, and so on.

In view of the above, the system and the method of reducing the power consumption of the display panels include: obtaining the brightness of each of the pixels of the display panel, calculating the average brightness of the displayed image in accordance with the brightness of each of the pixels, obtaining the brightness adjustment coefficient in accordance with the average brightness, decreasing the brightness of each of the pixels of the displayed image in accordance with the brightness adjustment coefficient, and enhancing the contrastness between the pixels of the displayed image in accordance with the brightness adjustment coefficient. In this way, when the brightness of pixels of the displayed image is decreased in accordance with the brightness adjustment coefficient, the contrastness between the pixels of the displayed image is enhanced in accordance with the brightness adjustment coefficient. Thus, though the power consumption of the display panel is reduced, the contrastness of the displayed image may not be decreased.

In the above embodiments, it can be understood that the disclosed system, device and method may be realized by other ways. For instance, the apparatus described in the above embodiments are merely illustrative, e.g., the division of modules or units. There may be other ways of dividing the actual implementation. For example, a plurality of units or components may be integrated into another system, or some features can be ignored, or can be skipped. In another aspect, the modules/units may be coupled or communicated, directly or indirectly, via interfaces. In addition, the connections between the modules/unis may be electrical, mechanical or in other forms.

Units described as a separate part may be or may not be physically separated unit, which may be located in one place, or it can be distributed to multiple network elements. In real scenario, a portion of the units or all of the units may be selected to achieve the technical effects of the claimed invention.

Further, examples of the functional units in respective embodiments of the claimed invention may be integrated in one processing unit. Each of the units may be a physical unit, or two or more units may be integrated into one unit. The integrated unit described above can be implemented in the form of hardware or software.

The integrated unit, when being implemented in the form of software as a standalone product, can be stored in a computer readable storage medium. Based on the understanding, the technical feature of the claimed invention, in part or completely, contribute to the proposed solution may be embodied in the form of software products, such as in a storage medium. The software medium includes a plurality of instructions instructing a computer device (may be a personal computer, a server, or network equipment) or processor (processor) to perform all or a portion of the steps of the various embodiments. The aforementioned storage media includes: U disk, removable hard disk, read-only memory (ROM, Read-Only Memory), a random access memory, etc. (RAM, Random Access Memory), disk or CD-ROM can store program code various media.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A method of reducing power consumption for an organic light emitting diode display panel, comprising:

obtaining a brightness of each of pixels of an image to be displayed on the display panel by a processor;

applying a Gamma transformation to the brightness of each of the pixels of the image, and calculating an average brightness of the image in accordance with the brightness after the Gamma transformation by the processor;

searching a corresponding value of the average brightness on a predetermined brightness adjustment curve, and obtaining a brightness adjustment coefficient in accordance with the corresponding value by the processor;

decreasing the brightness of each of the pixels of the image in accordance with the brightness adjustment coefficient by a Gamma IC or a data driver; and enhancing a contrast between the pixels of the image in accordance with the brightness adjustment coefficient by the Gamma IC or the data driver; wherein the brightness of the pixels of the image after the contrast between the pixels is enhanced is below the decreased brightness of the pixels; and wherein the enhancing a contrast between the pixels of the image in accordance with the brightness adjustment coefficient comprises:

determining a brightness threshold from a relationship curve for the brightness adjustment coefficient;

decreasing the decreased brightness of the pixels whose decreased brightness is below the brightness threshold; and increasing the decreased brightness of the pixels whose decreased brightness is above the brightness threshold.

2. A method of reducing power consumption for an organic light emitting diode display panel, comprising:

obtaining a brightness of each of pixels of an image to be displayed on the display panel by a processor;

calculating an average brightness of the image in accordance with the brightness of each of the pixels of the image by the processor;

obtaining a brightness adjustment coefficient in accordance with the average brightness by the processor;

decreasing the brightness of each of the pixels of the image in accordance with the brightness adjustment coefficient by a Gamma IC or a data driver; and enhancing a contrast between the pixels of the image in accordance with the brightness adjustment coefficient by the Gamma IC or the data driver; wherein the brightness of the pixels of the image after the contrast between the pixels is enhanced is below the decreased brightness of the pixels; and wherein the enhancing a contrast between the pixels of the image in accordance with the brightness adjustment coefficient comprises:

determining a brightness threshold from a relationship curve for the brightness adjustment coefficient;

decreasing the decreased brightness of the pixels whose decreased brightness is below the brightness threshold; and increasing the decreased brightness of the pixels whose decreased brightness is above the brightness threshold.

3. The method as claimed in claim 2, wherein the step of obtaining the brightness of each of pixels of the image to be displayed on the display panel further comprises:

obtaining grayscale values of R, G, and B components of the image; and converting the grayscale values of the R, G, and B components into a brightness Y of a YcbCr space;

wherein the brightness $Y=0.299R+0.587G+0.114B$.

4. The method as claimed in claim 2, wherein the step of obtaining the brightness of each of pixels of the image to be displayed on the display panel further comprises:

obtaining grayscale values of R, G, and B components of the image; and selecting a maximum value among the grayscale values of the R, G, and B components to be the brightness of each of the pixels of the image.

5. The method as claimed in claim 2, wherein the step of calculating an average brightness of the image in accordance with the brightness of each of the pixels of the image further comprises:

applying a Gamma transformation to the brightness Y of each of the pixels of the image; and calculating an average brightness APL of the image in accordance with the brightness Y' after the Gamma transformation;

wherein $Y'=(Y/\text{maximum grayscale value})^{GMA}\times\text{maximum grayscale value}$, and the APL is obtained firstly with $APL=\Sigma_{i=1,j=1}^{i=m,j=n}Y'_{ij}/(m\times n)$ and then with $APL=APL/\text{maximum}\times 100$, m represents a number of rows, n represents a number of columns, the maximum grayscale value is 255 when the display panel is of 8 bits, and the maximum grayscale value is 1023 when the display panel is of 10 bits.

6. The method as claimed in claim 2, wherein the step of obtaining a brightness adjustment coefficient in accordance with the average brightness further comprises:

searching a corresponding value of the average brightness on a predetermined brightness adjustment curve, and obtaining a brightness adjustment coefficient in accordance with the corresponding value.

7. The method as claimed in claim 6, wherein the brightness adjustment curve is a curve showing a relationship between the average brightness and the brightness of one specific pixel after the adjustment, and the brightness adjustment coefficient is obtained in accordance with the adjusted brightness of the pixel and the brightness of the pixel before the adjustment.

8. The method as claimed in claim 2, wherein the step of enhancing the contrast between the pixels of the image in accordance with the brightness adjustment coefficient further comprises:

reducing a Gamma voltage or a driving voltage of the display panel, changing data by a digital method, or decreasing the brightness of each of the pixels of the image.

9. The method as claimed in claim 2, wherein the step of enhancing the contrast between the pixels of the image in accordance with the brightness adjustment coefficient further comprises:

configuring an enhanced degree of the contrast between the pixels of the image to be lower when the brightness adjustment coefficient is larger, and configuring the enhanced degree of the contrast between the pixels of the image to be higher when the brightness adjustment coefficient is smaller.

10. The method as claimed in claim 9, wherein:

when the brightness adjustment coefficient is larger, the brightness of the pixel having a low grayscale is decreased to be at a lower degree, and the enhanced degree of the brightness of the pixel having a high grayscale is increased to be at the lower degree; and when the brightness adjustment coefficient is smaller, the brightness of the pixel having a low grayscale is decreased to be at a higher degree, and the enhanced degree of the brightness of the pixel having a high grayscale is increased to be at the higher degree.

11. A system of reducing the power consumption for an organic light emitting diode display panel, comprising:

a pixel brightness obtaining module is configured for obtaining a brightness of each of pixels of an image to be displayed of a display panel;

an average brightness calculation module is configured for calculating an average brightness value of the image in accordance with the brightness of each of the pixels;

a calculation module of brightness adjustment coefficient is configured for obtaining a brightness adjustment coefficient in accordance with the average brightness;

a brightness execution module is configured for decreasing the brightness of each of the pixels of the image in accordance with the brightness adjustment coefficient; and a contrast execution module is configured for enhancing a contrast between the pixels of the image in accordance with the brightness adjustment coefficient, wherein the brightness of the pixels of the image after the contrast between the pixels is enhanced is below the decreased brightness of the pixels; and wherein the enhancing a contrast between the pixels of the image in accordance with the brightness adjustment coefficient comprises:

determining a brightness threshold from a relationship curve for the brightness adjustment coefficient;

decreasing the decreased brightness of the pixels whose decreased brightness is below the brightness threshold; and increasing the decreased brightness of the pixels whose decreased brightness is above the brightness threshold;

wherein the brightness execution module and the contrast execution module are a Gamma IC or a data driver.

12. The system as claimed in claim 11, wherein the pixel brightness obtaining module further comprises:

a pixel grayscale obtaining unit configured for obtaining grayscale values of R, G, and B components of the image; and a pixel brightness calculation unit configured for converting the grayscale values of the R, G, and B components into a brightness Y under the YcbCr space, wherein Y=0.299R+0.587G+0.114B or selecting a maximum grayscale value among the R, G, and B components to be the brightness of each of the pixels of the image.

13. The system as claimed in claim 11, wherein the average brightness calculation module further comprises:

a conversion unit configured for applying a Gamma transformation toward the brightness Y of each of the pixels of the image;

an average brightness calculation unit configured for calculating the average brightness APL of the image in accordance with the transformed brightness Y';

wherein $Y'=(Y/\text{maximum grayscale value})^{GMA}\times\text{maximum grayscale value}$, and the APL is obtained firstly with $APL=\Sigma_{i=1,j=1}^{i=m,j=n}Y'_{ij}/(m\times n)$ and then with $APL=APL/\text{maximum}\times 100$, m represents a number of rows, n represents a number of columns, the maximum grayscale value is 255 when the display panel is of 8 bits, and the maximum grayscale value is 1023 when the display panel is of 10 bits.

14. The system as claimed in claim 11, wherein the calculation module of brightness adjustment coefficient is configured for searching a corresponding value of the average brightness on a predetermined brightness adjustment curve, and for obtaining a brightness adjustment coefficient in accordance with the corresponding value.

15. The system as claimed in claim 14, wherein the brightness adjustment curve is a curve showing a relationship between the average brightness and the brightness of one specific pixel after the adjustment, and the brightness adjustment coefficient is obtained in accordance with the adjusted brightness of the pixel and the brightness of the pixel before the adjustment.

16. The system as claimed in claim 11, wherein the brightness execution module is configured for decreasing the brightness of the image by reducing a Gamma voltage or a driving voltage of the display panel, changing data by a digital method, or decreasing the brightness of each of the pixels of the image.

17. The system as claimed in claim 11, wherein the contrast execution module is configured for:

configuring an enhanced degree of the contrast between the pixels of the image to be lower when the brightness adjustment coefficient is larger, and configuring the enhanced degree of the contrast between the pixels of the image to be higher when the brightness adjustment coefficient is smaller.

18. The system as claimed in claim 17, wherein the contrast execution module is configured for:

when the brightness adjustment coefficient is larger, the brightness of the pixel having a low grayscale is decreased to be at a lower degree, and the enhanced degree of the brightness of the pixel having a high grayscale is increased to be at the lower degree; and when the brightness adjustment coefficient is smaller, the brightness of the pixel having a low grayscale is decreased to be at a higher degree, and the enhanced degree of the brightness of the pixel having a high grayscale is increased to be at the higher degree.

* * * * *